US005105985A

United States Patent [19]

Kroeber

[11] Patent Number: 5,105,985

[45] Date of Patent: Apr. 21, 1992

[54] SQUEEZABLE TUBE WITH PRESSURE OPERATED OUTLET ELEMENT

[76] Inventor: Lutz Kroeber, Hermann-Vogel-Strasse 17, D-8000 Muenchen 40, Fed. Rep. of Germany

[21] Appl. No.: 449,890

[22] PCT Filed: May 27, 1988

[86] PCT No.: PCT/EP88/00476

§ 371 Date: Nov. 30, 1989

§ 102(e) Date: Nov. 30, 1989

[87] PCT Pub. No.: WO88/09753

PCT Pub. Date: Dec. 15, 1988

[30] Foreign Application Priority Data

Jun. 1, 1987 [DE] Fed. Rep. of Germany ..... 3718316
Dec. 4, 1987 [DE] Fed. Rep. of Germany ..... 3741163
May 4, 1988 [DE] Fed. Rep. of Germany ..... 3715162

[51] Int. Cl.[5] ..... B65D 35/00

[52] U.S. Cl. ..... 222/107; 222/54; 222/97; 222/212; 222/215; 222/490; 222/494; 222/564

[58] Field of Search ..... 222/92, 94, 107, 212, 222/215, 206, 54, 564, 547, 490, 494, 496

[56] References Cited

U.S. PATENT DOCUMENTS

| | | | |
|---|---|---|---|
| 2,893,710 | 7/1959 | Goodman | 222/92 X |
| 2,905,364 | 9/1959 | Marraffino | 222/94 |
| 3,107,829 | 10/1963 | Makowski | 222/92 X |
| 3,643,834 | 2/1972 | Sabatino | 222/54 |
| 3,669,323 | 6/1972 | Harker et al. | 222/490 |
| 4,121,734 | 10/1978 | Soong et al. | 222/54 |
| 4,620,648 | 11/1986 | Schwartzman | 222/94 X |

FOREIGN PATENT DOCUMENTS

| | | | |
|---|---|---|---|
| 759104 | 1/1934 | France . | |
| 67878 | 5/1951 | Netherlands | 222/494 |
| 2102398 | 2/1983 | United Kingdom | 222/490 |

*Primary Examiner*—Kevin P. Shaver
*Attorney, Agent, or Firm*—Spensley Horn Jubas & Lubitz

[57] ABSTRACT

A tubular container for adhesive material includes a substantially tubular body and a relatively rigid spout. An insert disposed in the spout hinders the intrusion of air through the spout. A plate is positioned so that the edge of the plate abuts the shoulder of the tubular body. The plate is supported by the insert at locations spaced from the edge of the plate. The exertion of pressure on the center of the plate causes the edge of the plate to be separated from the shoulder of the tubular body, thereby defining a passage for adhesive material.

5 Claims, 4 Drawing Sheets

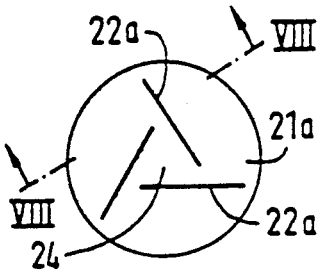
FIG.7
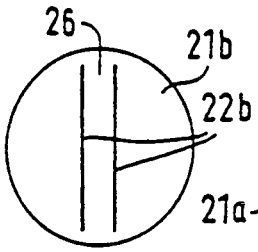
FIG.9
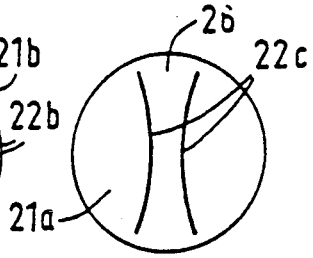
FIG.10
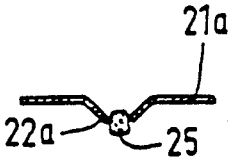
FIG.8
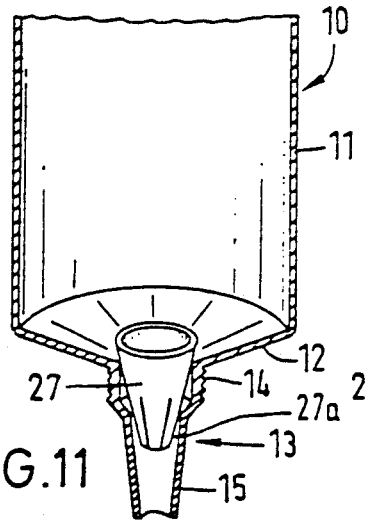
FIG.11
FIG.13
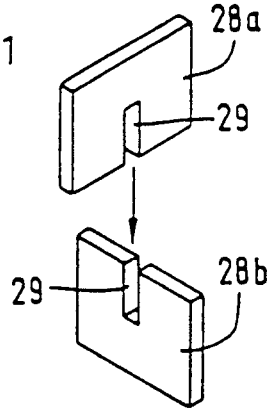
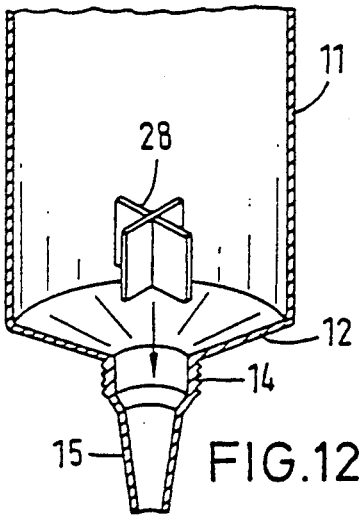
FIG.12
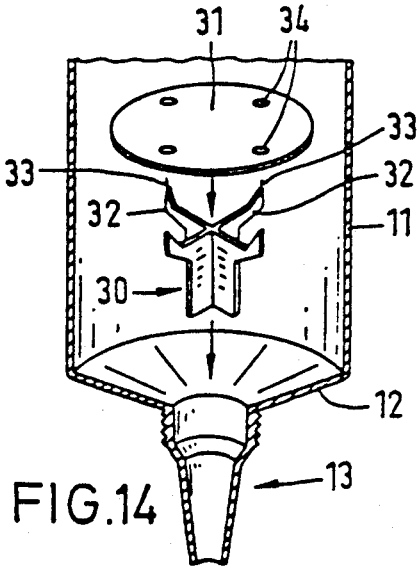
FIG.14
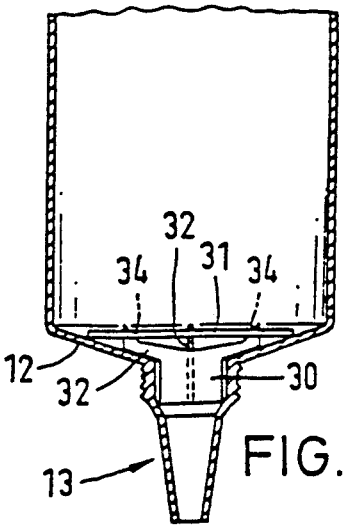
FIG.15

SQUEEZABLE TUBE WITH PRESSURE OPERATED OUTLET ELEMENT

BACKGROUND OF THE INVENTION

1. Field of the Invention

The invention is directed to a tube for adhesive material according to the precharacterizing part of claim 1.

2. Description of Related Art

A well-known annoyance of hobby workers who use tubes containing viscous adhesives is caused by enormeous difficulties in dosing the adhesive that issues out of the tube. On the one hand, it often happens that more adhesive than desired emerges initially, and on the other hand, the discharge of adhesive cannot be stopped with sufficient accuracy. In order to eliminate these disadvantages, adhesives with a different flowability have been developed. Such adhesives however, which have the flow characteristics of a gel, are often not accepted by consumers.

In the case of viscous masses of adhesive, one could use an elastic tube body capable of restoring its former shape, which tube body, after adhesive has been pressed out of it, effects a back suction. However, such a solution would entail the disadvantage that the tube body would not adapt to the decreasing contents, as is the case with a tube made of soft metal. If a tube body capable of restoring its former shape would be used, an empty space would be created within the tube body; this empty space would fill with air which could slowly harden the adhesive in the tube and which could expand under thermal influence and, after removal of the cap, could let the adhesive immediately and uncontrolledly escape due to the overpressure.

It is an object of the invention to provide a tube for adhesive material which effectively prevents uncontrolled issuing of adhesive material and outflow of adhesive material after use of the tube, wherein the commonly known tubes consisting of a tube body and a spout can be used without being altered and need only be provided with an additional device.

SUMMARY OF THE INVENTION

According to a first variant of the invention, an elastic insert with variable receiving volume is placed into the tube. This elastic insert consists e.g. of fibrous wool, particularly steel wool. Such a fibrous wool, being capable of restoring its former shape, exerts a retaining effect on the adhesive within the tube. The fibrous wool reacts elastically on slight pressure and can be completely flattened under stronger pressure. The fibrous wool can fill the whole volume of the tube. The flattened part of the tube maintains the fibrous wool flattend as well. In the part of the tube that is not squeezed off, the fibrous wool, when subjected to slight pressure, releases a portion of the adhesive sucked into it. When the pressure decreases, the fibrous wool sucks part of this adhesive back into the tube so that the flow of adhesive is ended in a defined manner. Thus, the adhesive can be dosed easily and exactly. It is even possible to use the adhesive for applying continuous fine or stronger lines and dots onto a pad.

As fibrous wool, steel wool of the strength No. 5 is particularly well suited. The fibrous wool need not necessarily fill all of the tube body. Moreover, it is sufficient when the fibrous wool is present in the front area of the tube. When fibrous wool is used, the . fibrous wool is introduced into the tube shortly before filling the tube with adhesive so that the tube bodies, having their rear end open upon delivery, can be delivered to the filling site as usual and without alterations.

According to a second variant of the invention, the elastic device consists of a small plate that is supported, e.g., at the level of the tube shoulder and is permeable upon deformation. This plate locks the volume of the tube spout against the volume of the tube body, and it is opened by the pressure of the adhesive. When the tube is subjected to pressure, the plate curves towards the spout, and a slot means lets the adhesive pass. When the pressure ends, the curving decreases, thereby effecting a short back suction. Even in the opened state, the passage width of the slot opening is smaller than the spout opening of the tube. The back suction, being caused due to the elasticity of the plate when the pressure onto the tube decreases, sucks adhesive from the outlet of the tube back into the tube.

Preferably, a triangular arrangement of small slots is used, while the slots do not touch one another.

When using an elastic small plate being provided with slots in the area of the spout, there is the problem that the plate has to be inserted into the tube before the tube is filled with adhesive. Thereby, a volume of air not being filled with adhesive remains before the plate in the spout. When using the tube containing the adhesive material, said volume of air must first be filled with adhesive before the adhesive issues out of the spout. This makes an unfavorable impression on the user. For avoiding this disadvantage, solids for maintaining the open state can be clamped into the slots, which solids, after the adhesive has been filled into the tube, are dissolved by the solvent contained in the adhesive. By means of the solids, the slots are kept open while the tube is filled so that the adhesive can flow into the spout area. Thereafter, the solids vanish by dissolving in the adhesive, and the slots are closed.

Using an elastic small plate, however, does not completely eliminate yet a further problem resulting from changes in temperature acting upon the tube. When the tube is heated, it is possible that the part of the tube that has already been flattened starts bulging out again. If the plate had only a very small inherent stability, then the pressure within the tube would open the plate, thus rendering control of the emerging adhesive impossible. Advantageously, the plate should have a higher stability against pressure than the tube body. Thus, it is effected that upon changes of temperature it is exclusively the tube body that is deformed while the plate is maintained in the closed state without bulging. On the other hand, the stability of the plate against pressure must not be selected so high that the plate offers too much resistance when adhesive is pressed out of the tube.

Preferably, the slots of the small plate open only after a certain initial deformation of the plate so that for opening of the slots, a threshold pressure has to be overcome first. This effect can be obtained by providing the plate with a cross bar delimited by two slots. When the plate is being curved, the edges of the slots are not pressed apart immediately, moreover, the two slots open only after a specific pressure of the adhesive has been overcome.

The difference in deformation between the cross bar and the sides of the plate becomes even larger and the danger of kinking is further diminished when the cross bar is concavely formed.

After each use of standard tubes containg adhesives, a tiny air bubble penetrates into the tube when the pressure on the tube body decreases. These air bubbles accumulate in the tube body because only a small part of them is blown out again during normal use. The more often the tube has been used, the larger becomes the volume of air accumulated therein. A tube which contains a large volume of air presses adhesive to the outside under even the slightest thermal influence, and the escaping of adhesive could be further favored by the gas pressure originating from the solvent. The small plate according to the invention does hinder the intrusion of air but is not adapted to entirely prevent this intrusion because in the closed state of the tube, pressure can accumulate in the antechamber before the plate and push a small amount of gas into the tube. In the first variant of the invention, the fibrous wool prevents the rising and accumulation of tiny air bubbles in the tube. In the second variant, a spout insert is preferably arranged in the spout in order to prevent the rising of air bubbles, said insert of the spout extending in lengthwise direction of the spout and dividing or narrowing the section of the passage of the spout. In this manner, comparatively narrow tubes are provided which hinder air from entering the tube body. The insert can consist of a spider structure or a conical spout insert. The insert can also consist of fibrous wool.

Preferably, the spout insert and the small plate are combined to form a functional unity, the edge of the plate abutting the shoulder of the tube and being lifted from said shoulder upon pressure on the central area of the plate. Of course, the moment of the pressurized surface of the central area of the plate must be larger than the moment acting on the outer edge surface. When filling in the adhesive, no particular precautions are needed for filling the volume before the plate since this volume is very small and thus negligable. A further advantage consists in the fact that the plate need not be fastened directly to the tube and, moreover, cannot jam and moves freely. Therefore production tolerances with regard to the tube and the plate as well as thermal extension of these parts cause no problems. The same tube insert and the same plate can be used equally for tubes of different sizes.

When the plate and the nozzle insert are manufactured of plastics material, this plastics material must be resistant to adhesive. In this respect, for example polyethylen is well suited.

BRIEF DESCRIPTION OF THE DRAWINGS

Embodiments of the invention will be explained in greater detail hereinafter with regard to the drawings.

In the drawings

FIG. 7 shows a small plate with a triangular slot arrangement, FIG. 8 is a sectional view of the plate, taken along the line VIII—VIII of FIG. 7 with the slots being held open for filling the adhesive, FIG. 9 shows another embodiment of the small plate, FIG. 10 shows a further embodiment of the small plate, FIG. 11 shows a spout insert contained in the spout for preventing air from being sucked in, FIG. 12 shows a cross-shaped spout insert, FIG. 13 shows the process of assembling the spout insert according to FIG. 12, FIG. 14 shows a combination of the spout insert and the small plate, FIG. 15 shows the construction according to FIG. 14 in the mounted state.

DESCRIPTION OF THE PREFERRED EMBODIMENTS

Figure 1:
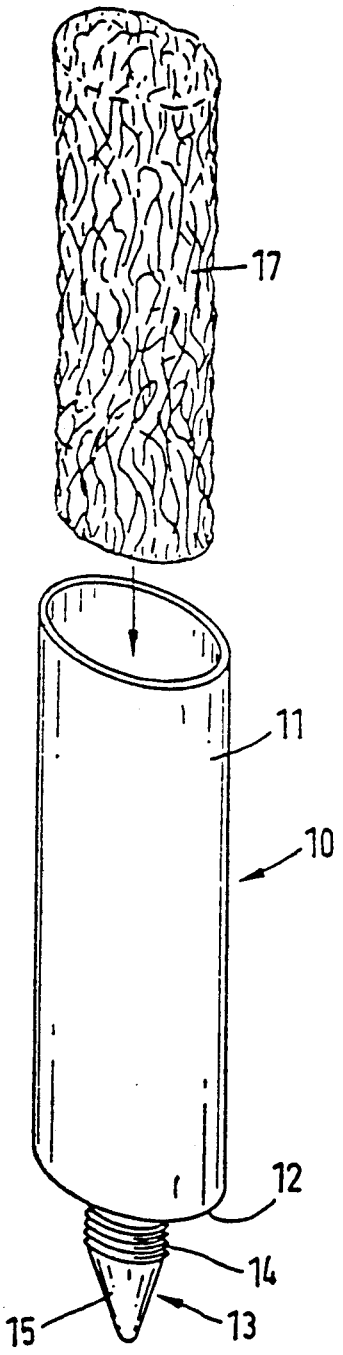
FIG. 1 is a perspective view of the process of filling fibrous wool into the tube body.
Figure 2:
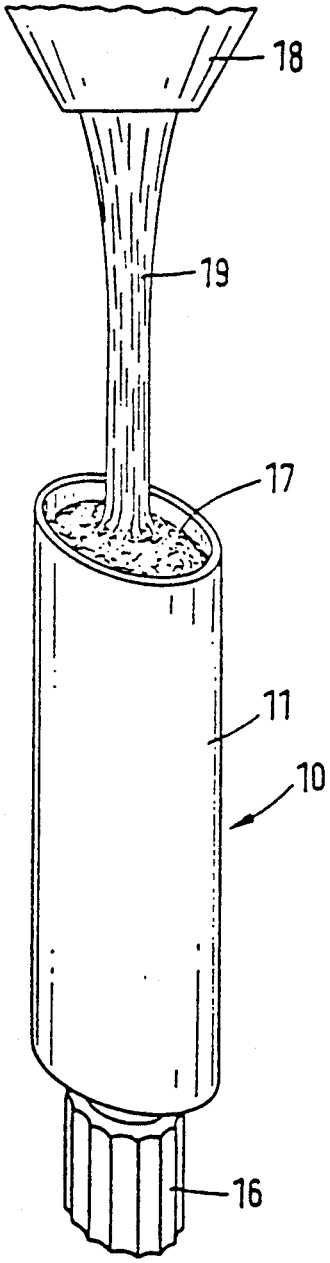
FIG. 2 shows the process of filling adhesive into the tube.
Figure 3:
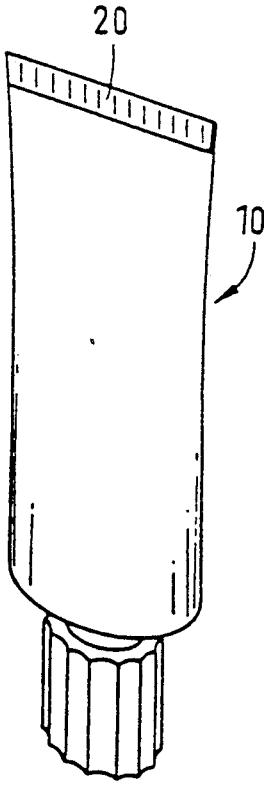
FIG. 3 shows the tube for adhesive in the filled and closed state.

FIGS. 1 to 3 show an embodiment of the first variant of the invention. The tube 10 consists of an initially cylindrical tube body 11 made of soft metal. At the one end of the tube body 11, there is provided a comparatively rigid truncated tube shoulder 12 being joined by the spout 13. Following the tube shoulder 12, the spout 13 comprises a threaded portion 14, and, following the threaded portion 14, a conical mouthpiece 15. A threaded cap 16 covering mouthpiece 15 can be screwed onto said threaded portion 14.

As FIG. 1 shows, fibrous wool 17 consisting of steel wool Nr. 5 is filled into the tube body 11 which is open at its rear end. The fibrous wool 17 is a porous body made of numerous irregularly entangled fibres. Generation of a coherent air volume within the tube body is thus inhibited.

After the fibrous wool 17 has substantially filled the tube body 11, adhesive 19 is filled out of a nozzle 18 into the rear open end of the tube body 11. After filling the tube, the rear end 20 is flattend and crimped over in the known manner for closing the tube.

When using the tube, cap 16 is removed, and by pressing the tube body 11, adhesive is pushed out of the spout 13. Since the fibrous wool 17 is capable of restoring its former shape, adhesive is sucked out of the spout 13 and into the tube body when the pressure decreases, thus avoiding subsequent dripping. On the other hand, adhesive is available for instant use without any dripping even when the tube has been stored with the spout pointing downwards.

Figure 4:
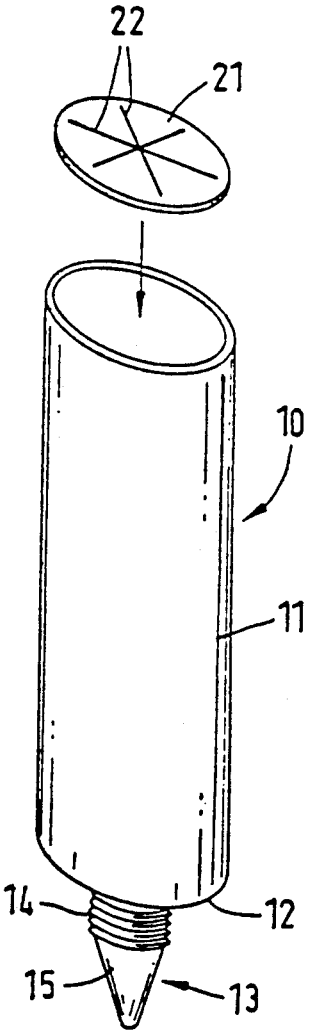
FIG. 4 shows the process of inserting a small plate into the tube according to another embodiment of the tube for adhesive.
Figure 5:
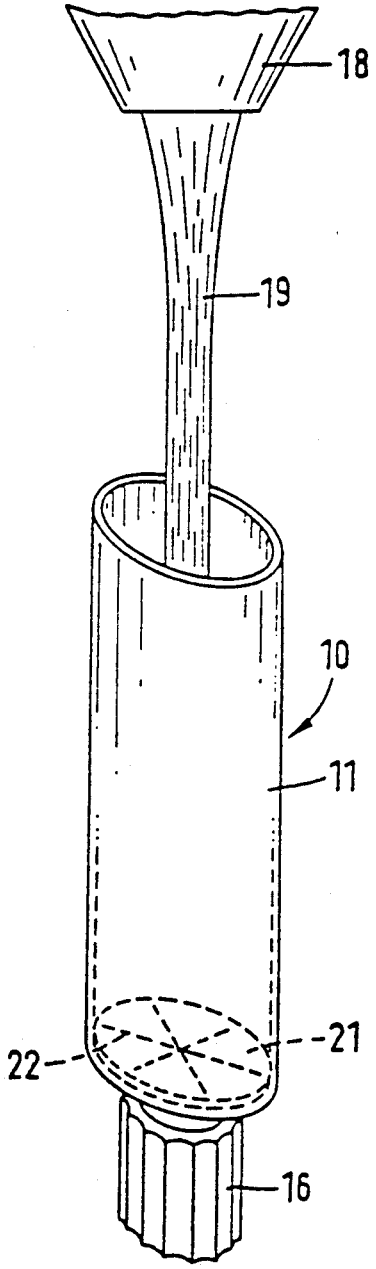
FIG. 5 shows the filling of the tube according to FIG. 4 with adhesive.
Figure 6:
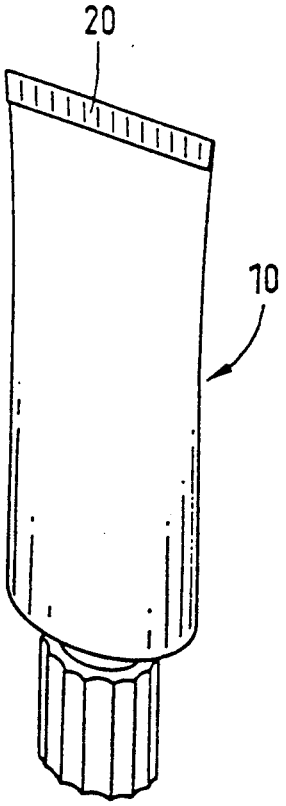
FIG. 6 shows the closed tube for adhesive according to FIGS. 4 and 5.

In the embodiment according to FIGS. 4 to 6, the elastic insert consists of a small plate 21 which is placed into the open tube body 11 before filling the tube and the edge of which is fixed at the inner side of the tube body, e.g. by tube shoulder 12. The plate is provided with slots 22.

After filling the adhesive 19 into the tube body 11 (FIG. 5), the tube 10 is closed at its rear end as is the case in the first embodiment.

Since the plate 21 is flat and has its outer edge abutting the conical tube shoulder 12, it can bulge out toward the spout in case of internal pressure in the tube body 11 while the slots 22 are opened.

The plate 21 is less deformable by pressure than the tube body 11. Should air have intruded into the tube body 11 with pressure accumulating in the tube body, this pressure blows up the tube body 11 to a small extent without the slots 22 of the plate being opened.

If, upon using the tube for adhesive material, the small plate 21 has been bulged towards the spout 13 and the pressure decreases thereafter, the plate returns to its flat condition, creating a suction in the spout 13 and thereby preventing subsequent dripping of the adhesive.

FIG. 7 shows a preferred embodiment of the small plate 21*a* having three slots 22*a* which are arranged around a center area 24 in triangular form without touching one another. The straight slots 22*a* extend tangentially to the center area 24 of plate 21*a*. The arrangement of slots according to FIG. 7 is neutral in direction so that the plate cannot be subjected to kinking in any preferred direction and already a small bulging deformation of plate 21*a* opens the slots 22*a*. The springiness of plate 21*a* is better than compared with other slot arrangements. When the edge of plate 21*a* is pressed, opening of the slots is not substantially impaired. Addditionally, the edge of the plate can be made softer by many small indentations. The slots 22*a* extend beyond the central area 24 until near the edge. Thus, there is provided a length of the slots sufficient for deformation. A slot arrangement consisting of four or five slots would have the disadvantage that the slots would have to be shorter. This would result in reduced permeability.

For filling also the area before the plate 21*a* when the adhesive 19 is filled in, the slots 21*a* can be maintained open by inserted solids according to FIG. 8. Said solids 25 consist of a material that dissolves under the effect of the solvent contained in the adhesive so that the slots close by themselves subsequently.

In the small plate 21*b* shown in FIG. 9, two parallel slots 22*b* are provided, defining a cross bar 26 running through the center of the plate.

FIG. 10 shows an embodiment in which the slots 22*c* have a curved shape and delimit a concave cross bar 26.

In the embodiment of FIG. 11, the spout 13 contains a conic spout insert 27 which, before the adhesive is filled in, is inserted in the tube being still open at its rear end. The spout insert 27 is arranged with a channel narrowing towards the front end, which channel reduces the inner section of the spout and impedes the rising of air into the tube. Between the small end of the spout insert 27 and the inner wall of mouthpiece 15, there is formed an annular space acting as a trap for air bubbles and impeding the rising of tiny air bubbles through the spout insert and into the tube body.

FIGS. 12 and 13 show a spout insert 28 which is clamped into the cylindrical channel of the theaded portion 14 and is supported at the rear end of mouthpiece 15. The spout insert 28 consists of two plates 28*a*, 28*b* crossing each other, said plates comprising a slot 29, respectively, and being fitted into each other by means of their slots so that they form a cross-shaped structure dividing the channel into a plurality of channel portions. Since each of the channel portions has a comparatively small section, the channel portions hinder the rising of air into the tube.

FIGS. 14 and 15 show another spout insert 30 which is combined with a small plate 31. The spout insert 30 consists of a cross- or spider-shaped structure 31. In this structure, the channel extending through the spout 13 is divided into a plurality of channel portions. The spout insert 30 is provided with arms 32 projecting radially to the outside, abutting the inner wall of tube shoulder 12 and carrying pins 33 protruding into tube body 11. Said pins 33 project respectively into openings 34 of plate 31 and support the plate against the pressure of the adhesive. If a pressure exists within the tube body, the plate 31 is curved toward spout 13 with the edge area of the plate being lifted from tube shoulder 12 so that an annular passage for the adhesive is created between the edge of plate 31 and the tube shoulder 12.

Figure 16:
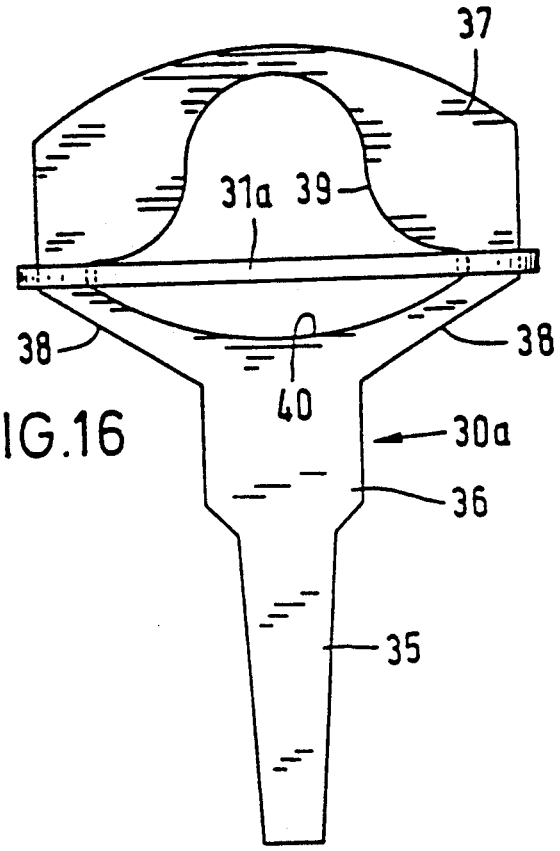
FIG. 16 shows a further embodiment of the spout insert.
Figure 17:
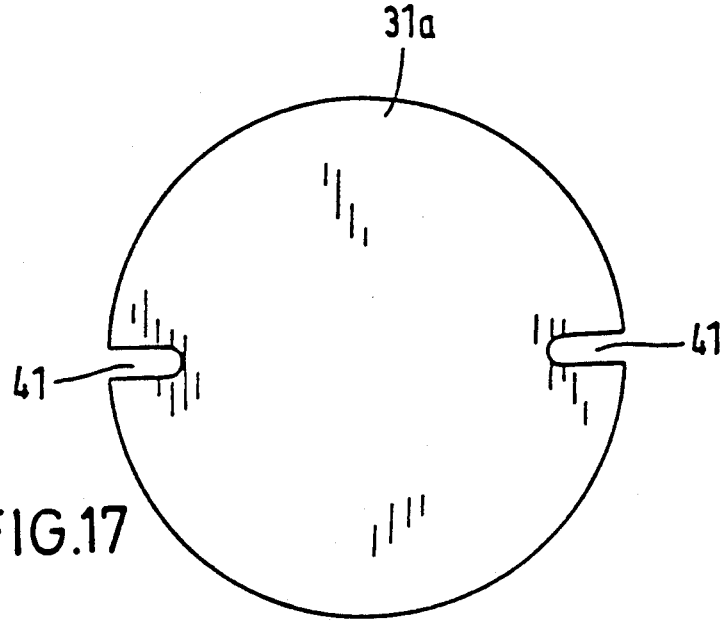
FIG. 17 shows the small plate belonging to the spout insert according to FIG. 16.

In the construction according to FIGS. 16 and 17, the spout insert 30*a* is made of a single one-pieced sheet comprising a narrow bar 35 projecting into mouthpiece 15 and being joined by by a wider bar 36 supported within threaded portion 14. The bars 35 and 36 divide the channel running through spout 13 into two channel portions. The wider part 36 is joined by a headpiece 37 having inclined flanks 38 abutting against the inner side of tube shoulder 12. The headpiece 37 has an opening 39 formed therein which is limited at the front by an arch-shaped edge 40 extending across the largest width of opening 39. In the opening 39, there is inserted the small plate 31*a* shown in FIG. 17, which plate 31*a* is circular and has its edge provided with two diametral slots 41. The plate 31*a* is clampingly arranged in opening 39, thus crossing this opening and abutting with its edge against tube shoulder 12. In case of pressure within the tube body 11, plate 31*a* bulges towards the edge 40. Upon bulging of the plate 31*a*, the edge thereof is lifted from the tube shoulder 12, thus providing an annular passage which allows adhesive to enter spout 13.

I claim:

1. A container for adhesive material comprising:

a substantially squeezable tubular body having a shoulder, a spout, the spout defining a channel and being relatively less flexible than the tubular body, an elastic insert disposed in the tubular body for hindering the intrusion of air through the spout, and a spout insert extending in the spout channel and including means for dividing the spout channel into a plurality of channel portions, wherein the elastic insert comprises a deformable plate supported by the spout insert, the deformable plate having an edge abutting an internal surface of the shoulder, and wherein the deformable plate deforms in response to internal pressure within the tubular body for establishing a gap between the edge of the plate and the internal surface of the shoulder through which the adhesive material is permitted to pass.

2. A container for adhesive material, comprising:

a substantially squeezable tubular body having a shoulder, a spout defining a channel and being relatively less flexible than the tubular body an insert disposed in the spout for hindering the intrusion of air through the spout, a deformable plate defining a plate center and a plate edge, the plate being positioned so that the plate edge abuts an internal surface of the tubular body shoulder and being supported by the insert at locations spaced from the plate edge, whereby internal pressure generated by squeezing the tubular body exerts pressure on the plate center and causes the plate to deform and the plate edge to be separated from the internal shoulder, thereby defining a passage for adhesive material in the tubular body upon deformation by fluid pressure within the tubular body.

3. A container for adhesive material according to claim 2, wherein the spout defines a channel and wherein the insert includes means for dividing the channel into a plurality of channel portions.

4. A container for adhesive material according to claim 2, wherein the spout defines a mouth-piece and a channel and wherein the insert comprises a one-piece sheet extending into the mouth-piece of the spout and dividing the channel into two channel portions.

5. A container for adhesive material according to claim 2, wherein the plate made of a material that is relatively more resistant to pressure than the tubular body.

* * * * *